US006177191B1

(12) United States Patent
Gupta et al.

(10) Patent No.: US 6,177,191 B1
(45) Date of Patent: Jan. 23, 2001

(54) INTERNALLY LUBRICATED FIBER, CARDABLE HYDROPHOBIC STAPLE FIBERS THEREFROM, AND METHODS OF MAKING AND USING THE SAME

(75) Inventors: Rakesh K. Gupta, Conyers; James H. Harrington, Stone Mountain, both of GA (US)

(73) Assignee: Hercules Incorporated, Wilmington, DE (US)

( * ) Notice: Under 35 U.S.C. 154(b), the term of this patent shall be extended for 0 days.

(21) Appl. No.: 09/025,890

(22) Filed: Feb. 18, 1998

Related U.S. Application Data

(62) Division of application No. 08/715,130, filed on Sep. 17, 1996, now Pat. No. 5,763,334.

(30) Foreign Application Priority Data

Aug. 6, 1996 (EP) ..... 96305779

(51) Int. Cl.[7] ..... D02G 3/00; B29C 47/88

(52) U.S. Cl. ..... 428/364; 428/394; 264/211.1; 264/211.12; 264/211.13; 264/143; 264/168

(58) Field of Search ..... 264/177, 211.1, 264/211.12, 211.13, 143, 168; 428/364, 394

(56) References Cited

U.S. PATENT DOCUMENTS

| | | | | |
|---|---|---|---|---|
| 4,446,090 | | 5/1984 | Lovgren et al. . | |
| 4,473,676 | | 9/1984 | Steklenski . | |
| 4,535,113 | | 8/1985 | Foster et al. . | |
| 4,659,777 | | 4/1987 | Riffle et al. . | |
| 4,923,914 | | 5/1990 | Nohr et al. . | |
| 4,938,832 | | 7/1990 | Schmalz . | |
| 5,318,735 | * | 6/1994 | Kozulla | 264/83 |
| 5,403,426 | * | 4/1995 | Johnson et al. | 156/256 |
| 5,721,048 | * | 2/1998 | Schmalz | 428/369 |
| 5,763,334 | * | 6/1998 | Gupta et al. | 442/360 |

FOREIGN PATENT DOCUMENTS

| | | |
|---|---|---|
| 0114348 | 8/1984 | (EP) . |
| 0264112 | 10/1988 | (EP) . |
| 0340763 | 5/1989 | (EP) . |
| 0486158 | 6/1992 | (EP) . |
| 0516412 | 12/1992 | (EP) . |
| 0557024 | 7/1993 | (EP) . |

OTHER PUBLICATIONS

"Bicomponent Fibers", Report No. 44, TRI/Princeton, Princeton, NJ (Dec. 1993).

* cited by examiner

*Primary Examiner*—William Krynski
*Assistant Examiner*—J. M. Gray
(74) *Attorney, Agent, or Firm*—John A. Parrish; John L. Wood

(57) ABSTRACT

Hydrophobic polyolefin fibers are provided with an internal hydrophobic polysiloxane of the formula $$X—[Si(R^1)(R^2)—O]_z—Y,$$

in which X, Y, $R^1$, and $R^2$, which may be the same or different, or substituted or unsubstituted independently of each other, are aliphatic groups having not more than about sixteen carbon atoms, $R^1$ and $R^2$ also being selected from among aryl groups, and z being a positive number sufficiently high that the polysiloxane is hydrophobic (z is generally a least 10). The invention also provides a novel polymer melt for spinning these hydrophobic fibers. The fibers can be cut into staple lengths and carded and bonded to form hydrophobic woven and nonwoven products suitable for use in hygiene devices such as diapers. Such devices are improved by these fibers, which, as spun, present a greater hydrophobicity than melt-spun polyolefin fibers lacking the internal siloxane lubricant, the improved hydrophobicity is evidenced by an advancing contact angle for the as-spun fibers of at least about 95°.

8 Claims, No Drawings

INTERNALLY LUBRICATED FIBER, CARDABLE HYDROPHOBIC STAPLE FIBERS THEREFROM, AND METHODS OF MAKING AND USING THE SAME

This appln is a Div of Ser. No. 08/715,130 filed Sep. 17, 1996, U.S. Pat. No. 5,763,334.

BACKGROUND OF THE INVENTION

1. The Field of the Invention

This invention pertains to hydrophobic polyolefin fibers, their fabrication, and to nonwoven fabrics made therefrom.

2. The State of the Art

Synthetic, polymeric fibers have found a wide range of applications, from textiles for clothing to reinforcement for tires. The particular application to which the fiber is put will dictate the physical and chemical properties required. Synthetic fibers are particularly useful in absorbent product, especially coverstock fabrics for diapers and other incontinence and hygiene products, such as sanitary napkins, tampons, underpants, and the like. Polyolefin and other fibers used in coverstock and similar fabrics that permit liquid to flow through them are hydrophobic. To facilitate the flow of liquid through them, they generally comprise a hydrophilic finish so that the liquid flows at a sufficiently high rate. The associated portions of such products, such as leg-cuffs, waist bands, and medical barriers, are also used to manage the flow of liquid as barriers rather than as channels. Accordingly, it is desirable for certain fibers used in these associated portions not only to be hydrophobic but also to have a fiber/finish surface that is hydrophobic.

To achieve the desired hydrophobicity, silicone fluids are conventionally added to the fiber surface by using such devices as a sprayer or a roller. Silicone fluids are also conventionally applied as a surface lubricant, thus, application of these fluids to the surface of the fiber provides a lubricated, hydrophobic fiber. When silicone fluids are used as a hydrophobic finish, they must firs be diluted in a solvent to allow for their application to the fiber surface in a controlled manner. In most cases, silicone fluids used on conventional hydrophobic polypropylene fibers are emulsified in an aqueous solution with the aid of wetting agents. One problem encountered with the use of emulsified silicones is a reduction in the hydrophobicity imparted by the silicone to the fiber surface due to the presence of the wetting agents used in the emulsion. Another problem in using topically applied silicone fluids is that a certain amount of necessary friction is lost because of the lubricity of the silicone fluid. Certain typical fiber processing operations, such as crimping and carding, require a minimum degree of friction between the fiber and parts of the processing equipment in order for the apparatus to manipulate the fiber. The topically applied silicone lubricant interferes with the frictional properties required for these operations. To compensate for the reduced friction, such operations must be performed at lower line speeds, and so the entire process must be slowed down to compensate.

Another problem encountered when using applied silicone (hydrophobic) lubricants, which stems from its alteration of the surface properties of the fiber, is that even when a fiber can be processed into staple fibers and crimped and carded into a web, the silicone lubricant interferes with the integrity of the web, allowing the carded staple fibers to slip past each other, and so the web begins to pull apart during processing. To compensate, the processing speed again must be slowed.

Yet another problem occurs when using antistatic finishes, which are typically hydrophilic in nature. These finishes are often applied to the fiber to facilitate handling the fiber during processing. Yet they can reduce the effectiveness of any lubricating finish on the fiber, requiring reapplication of the lubricant.

There is a balance between lubricating the fiber for its journey over and through processing equipment and the friction necessary for such equipment to engage and manipulate the fiber. Typically, silicone fluids are applied to the surface of fibers in very small amounts (<0.3 wt. %) to reduce friction. The control of such small levels of topically-added silicone to achieve a uniform application on the fiber surface is very difficult. Also, a severe reduction in fiber friction (from over-application of silicone) can result in various processing problems, including reduced line speeds. On the other side, if a hydrophilic spin finish is first applied to the fiber in order to avoid problems using small amounts of silicone, even if in combination with a silicone lubricant, then the resulting fiber remains hydrophilic.

Examples of more recent fibers having a lubricant thereon are described by Schmalz in U.S. Pat. No. 4,938,832 and EP 0486158A2 (corresponding to U.S. patent application Ser. No. 07/914,213 filed Jul. 15, 1992, abandoned in favor of continuation application Ser. No. 08/220,465, now U.S. Pat. No. 5,721,048, the disclosures of which are incorporated herein b reference), in which the spun fiber is treated with finishes comprising neutralized phosphoric acid esters and polysiloxane compounds.

Johnson and Theyson, in U.S. Pat. No. 5,403,426 and EP 0 516 412 A2 (the disclosures of which are both incorporated herein by reference), describe a cardable hydrophobic polyolefin-containing fiber made with finish compositions including neutralized phosphoric acid esters and lubricants such as esters, polyesters, glycols, capped glycols, alkoxylated products (such as polyoxyethylene or polyoxypropylene), and highly polar or ionic structures made therewith (such as methyl ethyl ammonium methylsulfate) and other compounds described therein. Optionally, such a finish is used in conjunction with an overfinish comprising a neutralized phosphoric acid and optionally a polysiloxane.

Harrington, in EP 0 557 024 A1 and U.S. patent application Ser. No. 08/016,346, now U.S. Pat. No. 5,545,481 which is a continuation of application Ser. No. 07/835,895, abandoned disclosures of which are all incorporated herein by reference), describes polyolefin fibers and nonwoven products made therefrom where the fibers include in their surface an antistatic composition comprising at least one neutralized $C_{3-12}$ alkyl or alkenyl phosphate alkali metal or alkali earth metal salt and a solubilizer, such as glycols, polyglycols, glycol ethers, and neutralized phosphoric ester salts having the general formula $(MO_x—(PO)—O(R_1)_nR)_y$, wherein M is an alkali or alkali earth metal or hydrogen, R is a $C_{16}$–$C_{22}$ alkyl or alkenyl group, $R_1$ is ethylene oxide or propylene oxide, and n is 1 to 10, x is 1 to 2, y is 2 to 1, and x+y=3. The finish may also contain a lubricant such as mineral oils, paraffinic waxes, polyglycols, and silicones.

Nohr and MacDonald, in U.S. Pat. No. 4,923,914, describe a fiber or film forming polyolefin composition having a particular polysiloxane additive, these additives are generally hydrophilic. The additive is compatible with the polyolefin at melt extrusion temperatures but is incompatible at temperatures therebelow, and is comprises of two moieties, provided in the same additive or in separate additives, if provided as separate additives, both are incompatible with the polyolefin at all temperatures. The moieties are both alkoxy groups, in one case the groups capping the end of the siloxane chain, and in the other case the groups being pendant from the backbone. As a result of the incompatibility, the additive has a concentration with the fiber that increase from the fiber axis to its surface.

Lovgren et al., in U.S. Pat. No. 4,446,090, describes blending high viscosity silicone fluids of a variety of compositions into a variety of different thermoplastic polymers. The ratio of high viscosity silicone fluid to thermoplastic polymer is within the range of 0.005–200.0. The process is especially useful for flame retardant silicone fluids.

Riffle and Yilgor, in U.S. Pat. No. 4,659,777, describe polysiloxane/polyoxazoline copolymers which, when incorporated into a fiber-forming composition, provides a fiber wettable by both polar and non-polar liquids.

Foster and Metzler, in U.S. Pat. No. 4,535,113, describe an olefin polymer composition containing siloxane additives useful for the production of films. The siloxane includes pendant from its polymer backbone a monovalent organic radical containing at least one ethylene oxide group, a vicinal epoxy group, or an amino group.

Steklenski, in U.S. Pat. No. 4,473,676, describes incorporating a cross-linked silicone polycarbinol into film-forming compositions to make polymer compositions having a low coefficient of friction and useful for protective layers in photographic elements.

Hansen et al., in U.S. Pat. No. 5,456,982, describe incorporating a surface active agent, such as an emulsifier, surfactant, or detergent, into the sheath component of a sheath-and-core type bicomponent fiber to render the fiber hydrophobic.

Silicone additives such as described by Nohr and MacDonald (noted above), which are incompatible with the bulk polymer at ambient temperatures but compatible at spinning temperatures, take advantage of a problem with such additives. Higher molecular weight for such additives render the additive less soluble in polypropylene (and in other polyolefins). However, using a lower molecular weight silicone decreases the thermal stability of the lubricating additive.

Also as noted above, it is very difficult to control the topical application of an applied surface finish having ingredients in amounts on the order of only a few tenths of one percent of the total finish composition. It is thus very difficult to provide a homogeneous finish composition having only about 0.3% of the silicone additive, and it is very difficult to provide a uniform coating of such a finish on a fiber. The use of an insufficient amount of lubricant in the finish can be very disruptive to commercial operations. Also, use of too much silicone (which can be on the order of only one-tenth of one percent) can render the fiber too slippery for processing, especially crimping, at commercial speeds. Further, even if the fibers can be crimped and processed into a non-woven web, the strength of the web can be significantly decreased because silicone oil at the surfaces of the fibers to be consolidated (e.g., heat-bonded) interferes with the bonding of the fibers to each other.

SUMMARY AND PRINCIPAL OBJECTS OF THE INVENTION

In view of the foregoing, it would be beneficial to provide a highly hydrophobic fiber which is easily processed without the occurrence of unworkability.

It would also be beneficial to provide such a hydrophobic fiber with which applied aqueous lubricants do not undermine the desired hydrophobic nature of the fiber. Aqueous lubricants, applied as a surface finish, provide advantages over non-aqueous surface lubricants (such as silicone oils) in their facility in being applied and removed, their lower toxicity, and their ease of dispersion (and thus uniformity of the lubricant coating after having been applied to the fiber surface).

It would be an additional benefit to provide such a fiber having improved hydrophobicity for improved barrier properties and to increase commercial processing speeds.

Yet another benefit would be to provide a hydrophobic fiber intrinsically lubricated effective to allow processing of the fiber into a carded, nonwoven article without the application of a lubricating finish. In relation to the state of the art, such a fiber would provide an improvement in conventional processing by eliminating one or more lubricating finish application steps.

Still a further benefit would be to provide such a hydrophobic fiber with a thermally stable intrinsic lubricant.

Yet another benefit would be to provide an as-spun polyolefin-containing fiber having a contact angle, especially an advancing contact angle, greater than the intrinsic contact angle of such a polyolefin.

In another aspect, this invention provides a fiber-formable melt composition useful for melt spinning a fiber which, as spun, has an improved hydrophobicity and an improved lubricity. This novel polymer melt preferably comprises an intimate admixture of a fiber-forming polyolefin, especially having ethylene and/or propylene units, with a polysiloxane.

In yet another embodiment, this invention provides an internally lubricated polyolefin fiber, preferably also hydrophobic, having an essentially non-extractable internal lubricant.

This invention also provides a novel as-spun polyolefin fiber comprising an internal polysiloxane and having a contact angle greater than a comparable polyolefin fiber without the internal polysiloxane. The increased contact angle means that that the novel as-spun fiber is more hydrophobic than that without the internal polysiloxane. The present fibers preferably have an intrinsic contact angle of at least 95°, more preferably at least about 96°, even more preferably at least about 100°, still more preferably at least about 105°, and most preferably at least about 110° ore more.

Providing these and other benefits, in one embodiment the present invention provides a hydrophobic fiber having an internal lubricant (i.e., it can be processed without an applied topical lubricating finish composition). Optionally, the fiber can be provided with a topically applied hydrophilic antistatic finish. In either case, the fiber is processable into a carded nonwoven article, at commercial speeds, while maintaining hydrophobicity.

More particularly in another embodiment, this invention provides a polyolefin-containing fiber or a polyolefin-containing fiber-formable composition, depending upon whether the composition is in a molten or a solidified state, which comprises an internal polysiloxane of the general formula $$X\text{—}[Si(R^1)(R^2)\text{—}O]_z\text{—}Y,$$

in which X, Y, $R^1$, $R^2$, are independently selected from hydrophobic and non-polar groups, preferably hydrocarbyl groups, more preferably alkyl, alkenyl, alkynyl, cycloalkyl, and/or aralkyl groups, and/or aryl substituted with any of the foregoing groups, having up to about twenty two, and more preferably up to about sixteen carbon atoms, and ethers thereof, $R^1$ and $R^2$ can also be independently selected from hydrophobic and non-polar alkyl, aryl, and heterocyclic groups, and z is a positive number sufficiently high that the polysiloxane is hydrophobic. The fiber is "polyolefin-containing" when at least half, preferably at least about 75%, more preferably at least about 90%, and even more preferably at least about 95% of the weight of the structural component of the fiber (i.e., exclusive of additives) is polyolefinic. The polysiloxane is "hydrophobic" in the common sense of having no affinity for water, and functionally, with respect to certain preferred embodiments of this invention, provides a hydrophobic fiber surface, especially for the above-mentioned hydrophobic fibers useful in barrier devices. In preferred embodiments, $R^1$ and $R^2$ are independently selected from unsubstituted and substituted hydrophobic straight and branched chain alkyl groups having not more tan about sixteen carbon atoms, more preferably not more than about eight carbon atoms, and aryl groups (e.g., phenyl) optionally substituted with up to three hydrophobic alkyl groups. In other preferred embodiments, X and Y are lower alkyl groups having not more than about sixteen carbon atoms, and more preferably not more than about eight carbon atoms. In yet other preferred embodiments, z ranges from about 10 to about 50 or more.

This invention also provides an as-spun polyolefin fiber having an intrinsic contact angle of at least about 95°, more preferably at least about 100°, still more preferably at least about 105°, and more preferably at least about 110° or more. By "instrinsic contact angle" is meant the contact angle of the as-spun fiber prior to the application of any topical finish. Thus, the novel as-spun fiber of this invention has a contact angle after having been spun, and without the application of a topical lubricant, greater than a comparable as-spun fiber without an internal lubricant. These novel fibers are essentially free from any surfactant present on their surface.

In yet another embodiment, this invention provides a polyolefin fiber having an essentially non-extractable lubricant. The novel fibers of this invention, having an internal lubricant, are not susceptible of having the lubricant removed from the surface of the fiber, in contrast to fibers having only a topically applied lubricant.

In still another embodiment, the invention provides a novel process for using these fibers, especially in the production of nonwoven articles and products therefrom, which preferably comprises providing a fiber-forming composition including a major portion of polyolefin and a compatible polysiloxane intimately admixed therewith, spinning the fiber-forming composition into one or more fibers, drawing the fibers, crimping the fibers, cutting the crimped fibers into staple lengths, and carding and consolidating the fibers to produce a nonwoven article. The nonwoven article is preferably further processed into a hygeine product, such as a diaper. A topical hydrophobic finish, preferably aqueous based, may optionally be applied to the fibers if necessary or desirable.

DETAILED DESCRIPTION OF PREFERRED EMBODIMENTS

The present invention concerns a polyolefin-containing, lubricated, fiber-forming composition, the fibers made therefrom, and intermediate and final articles made therefrom. By "fiber-forming" composition is meant a composition that is spinnable into fibers, preferably by melt spinning. The lubricant is preferably a hydrophobic polysiloxane.

The fiber-forming compositions useful in this invention preferably include melt spinnable polyolefins derived from straight and branched chain olefinic, preferably alkene, monomers having at lest two carbon atoms, preferably from about two to about eight carbon atoms or more, more preferably from about two to about four carbon atoms, and most preferably two or three carbon atoms (including polyethylene and polypropylene). The polyolefin may be a homopolymer or a copolymer (e.g., terpolymer), used alone or mixed or blended in various proportions with other polyolefin-containing homopolymers or copolymers. Examples of suitable polyolefins include, without limitation, polyethylene, polypropylene, poly(1-butene), poly(4-methyl-1-pentene), poly(α-methylstyrene), poly(o-methylstyrene), polybutadiene, and the like, and compatible mixtures and blends thereof. The most preferred composition is polypropylene, especially propylene homopolymer or a copolymer derived from at least 50% by weight, more preferably at least 75% by weight, and most preferably at least 90% by weight of propylene with the remainder derived from ethylene, butene, hexene, and mixtures thereof.

Also preferred are spinnable blends or mixtures of polymers comprising at least 50%, more preferably at lest 75%, and most preferably at least 90% by weight of propylene homopolymer.

The fiber-forming composition thus may include one or more fiber-forming polymers compatible with the polyolefin present therein. It is preferred that the fiber-forming composition have at least 90% by weight of polyolefin, although at least 75% polyolefin content can be suitable for certain applications, with the minimum quantity of polyolefin being not less than about 50% by weight. Suitable polymers for blending or alloying with the polyolefin can be selected from polyesters, polyamides, and polyaramides, and the like that are compatible with the other constituents. A preferred blend comprises poly(ethylene terephthalate) ("PET") and polypropylene. Preferred polyolefins include polyethylene homopolymer, polypropylene homopoloyer, and ethylene-propylene copolymer, and mixtures thereof. Especially preferred is a mixture of polyethylene polypropylene ranging from about 19:1 to about 1:19, from about 10:1 to about 1:10, from about 6:1 to about 1:6, and in approximately equal weight proportions of about 1:1, essentially any amount from pure ethylene or propylene homopolyer to approximately equal amounts of the two homopolymers (one of which can be substituted with an ethylene-propylene copolymer).

To the polyolefin-containing fiber-forming composition, preferably while it is in the form of polymer granules prior to melting, at least one polysiloxane of the formula $$X—[Si(R^1)(R^2)—O]_z—Y$$

is added. In this formula, X and Y may be the same or different and are independently chosen from hydrophobic and non-polar groups, preferably hydrocarbyl groups, more preferably aliphatic groups such as alkyl, alkenyl, alkynyl, and cycloalkyl groups, preferably $C_{1-22}$, more preferably $C_{1-16}$, even more preferably $C_{1-8}$, and most preferably $C_{1-3}$, and ethers thereof, for example, an octyl or octylsiloxy either thereof. $R^1$ and $R^2$, which may also be the same or different, are also aliphatic hydrophobic groups preferably selected from alkyl, alkenyl, alkynyl, and cycloalkyl groups, straight or branched chain, having not more than about twenty two carbon atoms, more preferably not more than about sixteen carbon atoms, even more preferably not more than about eight carbon atoms, and most preferably one to three carbon atoms, with one carbon atom being especially preferred, and are also preferably selected from arene groups, preferably phenyl, optionally substituted with up to three aliphatic groups (e.g., aralkyl such as dimethylphenyl) as defined previously for $R^1$ and $R^2$, most preferably, $R^1$ and $R^2$ are selected from unsubstituted $C_{1-3}$ alkyl and unsubstituted phenyl groups. The various aliphatic groups are preferably straight chained, although branched chains can also be suitable. As such, $R^1$ and $R^2$ are preferably selected from alkyl, alkenyl, alkynyl, cycloalkyl, araliphatic, aryl, and any of the foregoing substituted with any of the foregoing (e.g., aralkyl phenyl), and, hydrophobic, preferably non-polar derivatives thereof. Preferred non-polar derivatives include the ethers thereof, such as methoxy, ethoxy, ethoxymethoxy, benzoxy, and the like. Thus, the general formula for the polysiloxanes may be written as $$X—A^1—[Si(A^2R^1)(A^3R^2)—O]_z—A^4—Y$$

in which $A^1$, $A^2$, $A^3$, and $A^4$ are independently selected from a bond or oxygen, the other variables being as defined previously. The chain length z is a positive number sufficiently high that the polysiloxane is hydrophobic and preferably renders the polysiloxane compatible with the polymer in both the melted and the solidified states; z is generally on the order of 10–50 or more. Examples of suitable polysiloxanes for incorporating into the fiber-forming compositions of this invention include those used for finishes for fibers as described by Schmalz in U.S. Pat. No. 4,938,832, U.S. patent application Ser. Nos. 07/614,650 and 07/914,213, and European Pat. Appln. No. 486,158, and by Johnson et al, in U.S. patent application Ser. Nos. 07/706,450 and 07/973,583, and in European Pat. Appln. No. 516,412, the disclosures of which are all incorporated herein by reference. The preferred polysiloxanes are poly(dialkylsiloxane)s and poly(alkylarylsiloxane)s, particularly poly(dimethylsiloxane) and poly(methylphenylsiloxane). The preferred molecular weight for the poly(dialkylsiloxane) is at least about 15,000, more preferably in the range of from about 60,000 to about 450,000, more preferably from about 75,000 to about 275,000. For poly(alkylphenylsiloxane)s terminated with trimethylsiloxy groups, the preferred molecular weight range is from about 1500 to about 3500, more preferably in the range of from about 2000 to about 3000, with poly(methylphenylsiloxane) preferably having a molecular weight of about 2600, although significantly higher molecular weights can be used. (The molecular weight of the polysiloxane can be number average or weight average molecular weight).

Suitable polysiloxanes for the present invention are those that are miscible with the polyolefin-containing spinnable composition at ambient temperatures and preferably also during conditions suitable for spinning. In contrast to these polysiloxanes suitable for this invention, low molecular weight alkylsiloxanes typically incorporated into engineering resins are immiscible therewith and migrate (bloom) to the surface of the part due to their immiscibility with the bulk polymer at ambient conditions. As shown in the example below, the spinnable melts of this invention and the fibers spun therefrom are lubricated with a polysiloxane tailored so that there is significantly less migration of the polysiloxane to the surface of the fiber, as evidenced by minimal surface extraction of the internal polysiloxane after the passage of more than two years. The use of poly(alkylarylsiloxane)s in this invention also provides improved thermal stability of the polysiloxane at high spinning temperatures due to the presence of the aryl groups. The relatively high molecular weights for the poly(dialkylsiloxanes) also provide the benefit of improved thermal stability at higher spinning temperatures. In preferred embodiments, the polysiloxane is selected from (a) those having at least one of $R^1$ and $R^2$ selected from an arene group and (b) those as otherwise defined and having a molecular weight of at least about 15,000.

The internal polysiloxane is provided generally as an additive in amounts typically not more than about 10% by weight of the fiber and generally of at least about 0.01% by weight, more preferably in the range of about 0.05% to about 5% by weight, and most preferably in the range of about 0.1% to about 1.0% by weight of the fiber. For a particular addition of polysiloxane, lesser amounts are preferred as its molecular weight increases. For example, if a certain polyolefin composition comprising 1% by weight of a poly(dialkylsiloxane) having a molecular weight of about 100,000 is suitable in a particular application, the use of a poly(dialkylsiloxane) having a molecular weight of about 200,000 will preferably accomplish the same suitable result employing a lesser amount of the additive. The amount of the polysiloxane used is effective to increase thy hydrophobic nature of the polyolefin fiber surface beyond that of the as-spun fiber without the polysiloxane. It is also preferred that the amount of polysiloxane used is effective to lubricate (decrease the surface friction of) the as-spun fiber over that without the additive.

As has just been described, one embodiment of the present invention includes a novel spinnable melt comprising a major portion of a polyolefin and a polysiloxane of the formula $$X—A^1—[Si(A^2R^1)(A^3R^2)—O]_z—A^4—Y,$$

as defined hereinabove, preferably in amounts of about 0.01% to about 10% by weight of the spinnable composition.

The melt spinnable, fiber-forming composition can be processed into a unitary fiber, or a bicomponent fiber or biconsitutent fiber in such configurations as side-by-side, sheath-and-core, matrix with multiple cores (e.g., islands-in-the-sea), and multilobal. Exemplary compositional configurations can include a polyolefin side-by-side with the same or a different polyolefin (e.g, polyethylene/polypropylene, or both polypropylene with different molecular weights), when such fibers are heated, the different polyolefin portions undergo different shrinkages, whereby the fiber curves or curls (e.g., a self-crimping fiber). Likewise, exemplary sheath/core configurations include polyalkylene/polyalkylene or polyalkylene/polyester, such as polyethylene/polypropylene, polyethylene/PET, and polypropylene/PET. The present fibers may be provided individually, as a monofilament fiber, as a multifilament yarn, a spin bonded nonwoven, a meltblown nonwoven, or as a tow, bundle, or the like, or as a woven fabric.

The novel fibers of this invention so made, and woven and nonwoven articles made therefrom, are preferably hydrophobic. As measured using the modified Suter apparatus technique described below in Example 6, fibers of this invention desirably have a hydrostatic head of at least about 30, more preferably at least about 62, even more preferably at least about 102, and still more preferably at lest about 150 mm of water. Similarly, nonwoven fabrics preferably have a hydrostatic of at least about 25, more preferably at least about 50, still more preferably at least about 75, and even more preferably at least about 100 mm ( at a bond area pattern of about 15%). Average nonwoven fabric runoff is preferably at least about 30%, more preferably at least about 50%, still more preferably at least about 70%, even more preferably at least about 90%, and most preferably at lest about 95% or more.

Another measure of he hydrophobicity of the inventive fibers is that the as-spun fiber has a contact angle greater than an as-spun fiber of the same polymeric composition that lacks the polysiloxane additive of this invention. The contact angle of an as-spun fiber will be defined herein as the the "instrinsic contact angle." The intrinsic contact angle of an as-spun polypropylene homopolymer fiber is generally less than 95°. The intrinsic contact angle of as-spun fibers according this invention, having the internal polysiloxane as described above, is at least 95°, more preferably is at least about 96°, even more preferably it is at least about 100°, and still more preferably the intrinsic contact angle is at least a bout 105° or more. The contact angle can be determined from the Whilhelmy equation, $\theta=\cos^{-1}[F_w \div \gamma P]$, wherein $F_w$ is the wetting force, P is the perimeter of the fiber, and $\gamma$ is the surface tension of the liquid. In general, as described in the example below, a force balance is used to solve for the wetting force and thus the contact angle, alternatively, other methods, such as microscope measurement (i.e., actually viewing the fiber under a microscope to see the contact angle) are readily known and suitable.

The fibers of this invention are inherently- or internally-modified, in contrast to fibers that are surface-modified. Accordingly, he fibers of this invention provide the advantage of having an improved hydrophobicity. Prior art fibers achieve hydrophobicity by applying a hydrophobic finish composition to the surface of the fiber and by adding a hydrophobic agent that blooms to the surface of the fiber. The prior art hydrophobic additives are present at the surface in a form that is subject to removal b the various processes typically encountered in commercial operations, including contact with guides, rollers, and various forming (e.g., twisting, carding) apparatus, as well as contact with steam or other agents. In contrast, the novel fibers of this invention are provided with an essentially non-removable, essentially non-extractable, and essentially non-blooming lubricant at their surface. More particularly, the lubricant is essentially non-removable and non-extractable at room temperature using non-polar solvents. For instance, as descried in the Background section above, a surface finish is typically applied to fibers at a level of about 0.1–2% by weight of the fiber, after application, this surface finish can be extracted almost totally by an organic solvent. In contrast, the novel fibers of this invention, when subjected to the same extaction process, yield their lubricant to a significantly less degree, preferably at lest about 50% less, and more preferably at least about 60% less, than that extracted from topically lubricated fibers; the less the internal lubricant that can be extracted from the fiber surface, the more preferrable.

Because the present fibers do not need a topical lubricant, the fibers of this invention also provide lubricated fiber that is essentially free of emulsifier (or other surface active agents typically used with external finishes) on its surface. Thus, in another embodiment this invention provides a melt suitable for spinning into fibers that comprises a spinnable polyolefin-containing polymer composition and a lubricating composition, preferably a polysiloxane, the melt being substantially free of any solvent or emulsifier for the lubricant.

The fibers (as well as the melt from which they are made) may also contain such conventional additives as antacids (e.g., calcium stearate), antioxidants, degrading agents, and pigments and/or colorants (such as titanium dioxide), and the like. For example, the constituents of the present melt from which the fibers are spun typically includes, in addition to the polymer(s) being spun and the polysiloxane additive, an antioxidant (e.g., Irgafos 168); calcium stearate, and titania, all in amounts generally from about 0.01 wt. % to about 1.0 wt. %. Fibers of this invention may also preferably include biocides or antimicrobials. These additives can be present individually in individually varying amounts, typically, 0.01% to 3% of the compostiion may include one or more of these conventional additives.

As noted above, the polysiloxane is preferably added to the fiber-forming composition prior to melting, the additive can be mixed into the melt if desired. The fiber-forming composition is then spun into the novel continuous length fibers of this invention. The fiber may be further drawn to orient to fiber to a particular degree, if desired, by techniques known in the art. The final fiber is preferably about 0.11 to 44 decitex (dtex, 1 dpf=1.1 dtex), more preferably about 0.55 to 6.6 dtex, and most preferably about 1.1 to 3.3 dtex. Staple fibers may be prepared according to this invention by extrusion, spinning, drawing, crimping, and cutting, by such processes as described by Kozulla, in U.S. Pat. application Ser. Nos. 07/474,897, now abandoned, 07/683,635 now U.S. Pat. No. 5,318,735, 07/836,438 now abandoned, and 07/887,416 now U.S. Pat. No. 5,281,378 and 07/939,857, now U.S. Pat. No. 5,431,994 and in European Pat. Appln. No. 445,536, by Gupta et al. in U.S. patent application Ser. Nos. 07/818,772 now abandoned and 07/943,190 now aandoned; by Schmalz in U.S. Pat. No. 4,938,832, U.S. patent application Ser. Nos. 07/614,650 now abandoned and 07/914,213 abandoned in favor of continuation application Ser. No. 08/220,465 now U.S. Pat. No. 5,721,048; European Pat. Appln. No. 486,158 and by Johnson et al. in U.S. patent application Ser. Nos. 07/706,450 filed May 28, 1991 now abandoned and 07/973,583 filed Nov. 6, 1992 abandoned in favor of continuation patent application Ser. No. 115,374 now U.S. Pat. No. 5,403,426.

In various embodiments of products, a hydrophilic spin finish composition is applied to the fibers to aid in processing and handling. In preparing the fibers, it is preferred to use a water-soluble hydrophilic spin finish to reduce various processing problems such as occur during crimping. A benefit of the internal siloxane is facilitating removal of the hydrophilic finish, i.e., maintaining the hydrophobicity of the fiber. Hydrophilic finishes which have both lubricating and antistatic properties are especially preferred, an exemplary finish of this type comprises a mixture of polyethylene glycol 400 monolaurate and polyoxyethylene(5) tridecylphosphate neutralized with diethanolamine (available as LUROL PP-912 form George A. Goulston Co., Monroe, N.C.). Other such finishes are described in the above-reference patents and applications to Johnson and Theyson. The present invention empowers one to use a proportionally or relatively ore hydrophilic antistatic surface finish composition (e.g., sodium oleate) because of the improved ease of removal from the fiber surface due to the presence of the internal lubricant.

In the production of nonwoven materials, it is desirable to impart a degree of crimp to the fiber. Crimping is typically accomplished by funnelling a tow of fibers into a conduit through which the fibers are drawn. Steam and water are typically circulated in the conduit, whereby the fibers are effectively stuffed into a steam-heated box and crimped. The steam and water act as lubricants which help to impart crimp to the fiber, and this hot humid environment in the box typically acts to remove most if not essentially all of the hydrophilic finishing composition. A preferred crimping process and apparatus is disclosed by Sibal et al. in U.S.

patent application Ser. No. 08/235,306, filed Apr. 29, 1994 now U.S. Pat. No. 5,485,662; (the disclosure of which is incorporated herein by reference).

In another embodiment, a hydrophobic finish may be applied to the fiber. Preferably, an antistatic composition, such as any of those described by the aforementioned Harrington applications, EP 0 557 024 A1 and U.S. patent application Ser. No. 08/016,346 (filed Feb. 11, 1993, now U.S. Pat. No. 5,545,481, a continuation of 07/835,895, filed ), Feb. 14, 1992 now abandoned; Schmalz patent U.S. Pat. No. 4,938,832 and application EP 0 486 158 A2 (corresponding to U.S. patent application No. 914,213, abandoned in favor of continuation aplication 08/220,464, now U.S. Pat. No. 5,721,048 filed Jul. 15, 1992), and Johnson and Theyson, in U.S. Pat. No. 5,403,426 and EP 0 516 412 A2 (the disclosures of all of such patents and applications being incorporated herein by reference), is also applied to the fiber. Suitable hydrophobic finishing compositions include an antistatic agent in combination with a lubricant such as a polysiloxane; more specific examples include potassium $C_4$- or $C_6$-alkyl phosphate with poly (dimethylsiloxane)s, and potassium $C_{10}$-alkyl phosphate with hydrogenated polybutene. Because the present invention includes a lubricant intimately admixed with the fiber component, a suitable choice for the amount of lubricant in the fiber can obviate the need to use a lubricant in the finishing compositions. Thus, the invention provides the benefit of enabling the significant reduction, if not the elimination, of the amount of lubricant applied to the fibers in addition to an antistatic agent. Additionally, the novel fibers of this invention allow for the application of any of a variety of overfinishes, antistatic finishes, and the like, without comprising the inherent hydrophobicity of the fibers of this invention.

For nonwoven products, the fibers are then chopped into staple lengths typically in the range of about 5–350 mm long, preferred lengths are about 25–250 mm, more preferably about 25–75 mm, and most preferably about 30–50 mm. The fibers are preferably of a uniform denier, in ranges as described previously, although mixed deniers can be used if desired for a particular application.

Hydrostatic head testing (e.g., preformed as described in Example 6, below) on these staple fibers preferably provides a value of at least about 100 mm, more preferably at least about 135 mm, and even more preferably at least about 170 mm if not even higher.

The crimped staple length fibers are then carded, formed into a nonwoven web, and consolidated using any one of various techniques known in the art, including thermal bonding, needle punching, hydroentangling, and the like. Carding is preferably done using a continuous belt and bonding is preferably effected by contact with a heated calendering roll. Other methods for thermal bonding include other typical heat sources (e.g., hot air, heat lamps), sonic (ultrasonic), and laser bonding. The nonwoven fabric has a basis weight of about 6–108 g/m$^2$ and a cross-directional strength of at least about 1.93 N/5 cm (Newtons per five centimeters, 150 g/in) with a bond area of at least about 10% More preferably, the fibers are capable of being formed into a nonwoven fabric having a basis weight of about 12–36 g/m$^2$ and having a directional strength of at least about 3.86 N/5 cm with a thermal bond area of 15–45%, and most preferably the fibers are capable of being formed into a nonwoven fabric having a basis weight of about 18–36 g/m$^2$ and having a directional strength of at least about 6.755 N/5 cm with a thermal bond area of about 18–30%.

The present fibers, in the form of crimped staple fibers, provide nonwoven articles having a higher strength because, in contrast to other fibers, they do not have a hydrophobic silicone on the fiber surface that would interfere with fiber-fiber bonding to create the nonwoven article. The internally lubricated fibers of this invention are lubricated so that processing speeds are increased, provide nonwoven articles having higher bond strengths, and have an improved hydrophobicity, leading to improved nonwoven hydrophobic articles.

The fiber preferably has a sink time (ASTM D-1117-79) of at least about 0.8 hours and the nonwoven fabric has a percent runoff value (described below) of at least about 80%. More preferably, the fiber has a sink time of at least about 4 hours and the nonwoven fabric has a percent runoff value of at least about 85%. Most preferably, the fiber has sink time of at least about 20 hours and the nonwoven fabric has a percent runoff value of at least about 90%.

The fibers of this invention can be processed under typically commercial processing conditions. The production of fiber is preferably at least about 200 lb/hr, more preferably at least about 1000 lb/hr, and most preferably at least about 1500 lb/hr.

As described, this invention provides a normally hydrophobic polyolefin fiber, especially one comprised of polypropylene, having improved hydrophobicity. This improved property, especially when achieved with a lubricating composition such as the present siloxanes, improves the liquid barrier properties of the fiber and articles (both woven and nonwoven) made therefrom. This improved property also enables the use of aqueous (e.g., hydrophilic) and more environmentally friendly finishes for imparting antistatic, lubricant, and other properties to the fiber surface.

The present fibers can be processed into woven and nonwoven articles of manufacture. During various stages of such processing, these fibers are suitable for treatment with spin finishes, intermediate processing finishes, and over finishes as described in the various aforementioned patents and applications incorporated herein by reference, and as may be desirable for a particular processing scheme to achieve a desired article. These fibers are also useful for Various particular embodiments of the invention will be further described with reference to the following specific examples, which are meant to illustrate the invention and not to confine the invention to the particular materials and conditions described.

EXAMPLES 1A AND 1B

Polypropylene resin (melt flow rate of 12 g per 10 min, available from Himont, Inc., Wilmington, Del.) was admixed with 0.05% (Ex. 1A) and 0.30% (Ex. 1B) by weight of poly(dimethylsiloxane) having a molecular weight of 17,250 and a viscosity of 500 cS (centistokes). The mixture was melted and spun into fine denier, multifilament fibers. A spin finish comprising poly(ethylene glycol) 400 monolaurate and polyoxyethylene-5-tridecylphosphate neutralized with diethanolamine (available as LUROL PP-912, from G. A. Groulston Co., Monroe, N.C.) was applied to the fibers in an amount of about 0.3wt. % based on the weight of the fiber. These fibers were drawn to 2.42 dtex and then crimped. After crimping, a hydrophobic finish comprising a neutralized phosphoric acid ester (designated LUROL® AS-Y, available from G. A. Goulston, Co., Monroe, N.C.) and poly(dimethylsiloxane) (available from Union Carbide Chemical Co., Danbury, Conn.) was applied and the fibers were cut into 37.5 mm staple fibers.

The staple was then carded at a line speed of 76.2 m/min. into a nonwoven web, and then bonded using a heated calender (approximately 15% bond area pattern) into a fabric web having a basis weight of 24 g/m$^2$, the line speed and fabric weight were typical for commercial operations.

EXAMPLES 2A AND 2B

Following the same general procedure as described for Examples 1A and 1B, polypropylene resin was admixed with 0.50% and 1.0% by weight, respectively, of poly (dimethylsiloxane) having a molecular weight of 62,700 and a viscosity of 10,000 cS, and processed into staple fibers.

EXAMPLES 3A, 3B, 3C, AND 3D

Following the same general procedure as described for Examples 1A and 1B, polypropylene resin was admixed with 0.1%, 0.3%, 0.5%, and 1.0% by weight, respectively, of poly(dimethylsiloxane) having a molecular weight of 139,000 and a viscosity of 100,000 cS, and processed into staple fibers.

EXAMPLES 4A, 4B, AND 4C

Following the same general procedure as described for Examples 1A and 1B, polypropylene resin was admixed with 0.1%, 0.3%, and 0.5% by weight, respectively, of poly(methylphenylsiloxane) having a molecular weight of 2,600 and a viscosity of 500 cS, and processed into staple fibers.

EXAMPLE 5

Following the same general procedure, a control fiber was prepared by mixing polypropylene flakes with an antioxidant and calcium stearate and processed into staple fibers.

In all of the foregoing examples, the aforementioned Lurol PP-912 composition was applied to the fiber as a spin finish prior to crimping. These fibers are characterized as shown in Table 1.

TABLE 1

| Example Composition | Polysiloxane in fiber (wt. %) | Hydrophilic Spin Finish (wt. % based on fiber) |
|---|---|---|
| 1A | 0.05 | 0.30 |
| 1B | 0.30 | 0.30 |
| 2A | 0.50 | 0.30 |
| 2B | 1.00 | 0.30 |
| 3A | 0.10 | 0.27 |
| 3B | 0.30 | 0.25 |
| 3C | 0.50 | 0.30 |
| 3D | 1.00 | 0.30 |
| 4A | 0.10 | 0.20 |
| 4B | 0.30 | 0.20 |
| 4C | 0.50 | 0.33 |
| 5 | 0.00 | 0.30 |

The various fibers produced in these examples were then tested for sink times and fabric runoff, the results of which are shown in Table 2. The Sink Time Test (ASTM D-1117-79) is used to characterize the degree of wetting of fibers by determining the time for five grams of sample contained in a three gram basket to sink below the surface of water. The fabric runoff test is conducted as follows: place a 27.5 cm×12.5 cm sample of nonwoven fabric, with the rough side (i.e., pattern-side) face up over two sheets of Eaton-Dikeman #939 paper 12.5×26.9 cm long; the fabric and two sheets of paper are placed on a board with an incline of 10°; the tip of a separatory funnel is placed 2.5 cm from the top of the fabric and 2.5 cm above the center of the fabric sample; a weighed paper towel is place across and 0.625 cm from the bottom of the sample; the separatory funnel is filed with 25 ml of synthetic urine; the funnel stopcock is opened and the runoff is collected on the previously weighed paper; the wet paper is weighed to the nearest 0.1 g and the runoff percentage is calculated; the test is performed five times and the average is determined. The higher the percentage runoff value the greater the fabric hydrophobicity.

TABLE 2

| Example Composition | Polysiloxane in Fiber (wt. %) | Overfinish Level (wt. %) | Sink Time (hours) | Avg. Fabric Runoff (%) |
|---|---|---|---|---|
| 1A | 0.05 | 0.40 | >2 | 96 |
| 1B | 0.30 | 0.40 | >2 | 97 |
| 2A | 0.50 | 0.40 | >2 | 97 |
| 2B | 1.00 | 0.30 | >2 | 98 |
| 3A | 0.10 | 0.37 | >2 | 95 |
| 3B | 0.30 | 0.30 | >2 | 98 |
| 3C | 0.50 | 0.20 | >2 | 90 |
| 3D | 1.00 | 0.25 | >2 | 97 |
| 4A | 0.10 | 0.30 | >2 | 95 |
| 4B | 0.30 | 0.34 | >2 | 96 |
| 4C | 0.50 | 0.29 | >2 | 97 |
| 5 | 0.00 | 0.47 | 0.04 | 0 |

As shown by the results in Table 2, the staple fiber of this invention did not wet after two hours exposure in water (i.e., sink times greater than two hours); additionally, the fabric gave runoff values greater than 90%, typically greater than 95% runoff of synthetic urine. In contrast, staple and fabric samples from the control (Example 5) gave poor hydrophobicity as noted by sink times and runoff data from Table 2.

EXAMPLE 6A

The following ingredients were mixed in a Henschel mill; polypropylene resin (noted above, having a melt flow rate of 12 grams per ten minutes), 1.3wt. % poly(dimethylsiloxane) having a viscosity of 10,000 cst and a molecular weight of about 62,700; 0.02 wt. % antioxidant (IRGAFOS 168, available from Ciba Geigy Corp., Additive Division, Ardsely, N.Y.); 0.05 wt. % calcium stearate; and 0.20 wt. % titanium dioxide. The resulting mixture was melt extruded through a spinnerette into fine denier multiple as-spun fibers. A spin finish comprising 2.0% neutralized phosphoric acid ester (LUROL AS-Y) in water was applied to the as-spun fibers at a level of 0.05% based upon the dried fiber having the finish thereon. The fiber were drawn to 2.2 dpf (2.4 dtex), crimped, and an antistatic overfinish of LUROL AS-Y (as described above) was applied to the crimped fiber at a level of 0.08%. The fibers were then cut into 37.4 mm staple lengths. No topical lubricant (as a finish or otherwise) was applied to the fibers.

The staple fibers were carded at a commercial line speed of 76.2 M/min. into a nonwoven web, and then bonded (approximately 15% bond area pattern) using a heated calendar into a fabric web having a basis weight of 24 g/m$^2$. The line speed and fabric weight were typical of commercial operations.

Even without the use of a topical lubricant at any point in the operation, the fibers were processed (e.g., spun, drawn, crimped, and carded) at commercial speeds and without difficulty. The fibers and the nonwoven fabric had excellent hydrophobicity characteristics: a sink time of greater than 24 hours; an average fabric runoff of 98%; and a hydrostatic head of 100 mm for the fabric, and 175 mm for the fibers. Fabric runoff and sink times were determined as described above. Hydrostatic head was determined with a modified "Suter" apparatus as an alternative method to AATCC 1952-18 British Standard 2823 apparatus. The hydrostatic pressure was applied to the top of the carded staple fiber and was controlled by a rising column of water at a rate of 290 cc/min. The staple fiber holder was 3.7 cm (I.D.) by 3.0 cm long with a screen in the top and a cap with multiple holes to allow water to flow through. The diameter of the exposed fiber sample was 3.7 cm . A mirror was fixed so that the underside of the fiber sample could be observed. The water column height above the sample screen is 60.0 cm by 3.7 cm (I.D.) and water was added to the column through a 0.5 cm diameter vertical hole 2.0 cm above the sample screen. A 0.50 cm diameter hole was placed 0.5 cm above the sample screen of the column to remove the water after each test. To begin testing, the column drain hole is plugged and 5 g. of carded fibers were placed in the sample holder and compressed tightly therein. Water was pumped into the column until leakage occurred through the sample. The test was repeated five (5) times. Additionally, carded and bonded fabric was tested using a fabric sample holder having the same dimensions as the fiber sample holder. For testing fabric, a 10 cm by 10 cm piece of fabric was placed in the sample holder and clamped to the base of the column.

EXAMPLE 6B

The fine denier as-spun fibers made as described in Example 6A were tested to determine their contact angle with reference to control fibers. As noted in Ex. 6A, the subject fibers included 1.3 wt. % internal poly (dimethylsiloxane). The control fibers were made by melt spinning a polypropylene homopolymer composition including 0.03 wt. % Irgafos 168 antioxidant, 0.1 wt. % calcium stearate antacid, and 0.06 wt. % titania.

An approximately 5½-inch (14 cm) length of the as-spun fiber of Ex. 6A was cut. One end of the fiber was attached to a platinum sinker (a plumb) and the other end was glued to a hook; the glue was allowed to dry overnight.

A solution was prepared from water to which 1 wt. % Zonyl solution; Zonyl is a trademark for a fluorosurfactant wetting agent available from E. I. DuPont de Nemours & Co. (Wilmington, Del.). The water was deionized water with a minimum surface tension of about 71 dynes/cm. The literature value for the surface tension of a 1% aqueous Zonyl surfactant solution is 17.4 dynes/cm.

As mentioned above, the contact angle θ is related to (i) the wetting force between the wetting liquid and the surface whose characteristics is to be measured and (ii) the surface tension of the wetting liquid; this relationship is defined by the Wilhelmy equation $\theta=\cos^{-1}[F_w \div \lambda P]$. The system in which these parameters are measured includes a fiber sample to be tested and a bath of fluid in which the fiber partially resides, as the fiber and fluid are moved relative to each other in the direction of gravity, the total force on the fiber $F_T$ is equal to the sum of the wetting force $F_W$ and the bouyant force $F_B$. For these fibers, the apparatus used comprised a motor-driven movable stage on which a container of the wetting fluid was moved and above which the prepared fiber (glued to the hook) was suspended, this apparatus was located in a cage isolating the materials from air currents. The fiber was suspended from a balance communicating with an electrobalance, the communication interface also connecting with a desktop computer, a printer therefor, and a chart recorder.

In brief, the surface tension of the water and the surfactant solution were both measured; the average value for the surface tension of the water was 72 dynes/cm and the literature value was used for the surfactant. Then, with the fiber suspended above the container of wetting fluid, the stage is raised to immerse the fiber in the wetting fluid until the plumb is just immersed, and the apparatus is then zeroed. Thereafter, the stage with the wetting liquid is moved further upwards; and the new fiber weight is recorded as the stage moves (this is handled by the automated electrobalance, available from Cahn Instrument Company); since the fiber is thus being immersed into the wetting fluid, this is a measurement of the advancing contact angle (as opposed to a retreating contact angle if the fiber were being withdrawn from the wetting fluid). Having the first weight of the fiber (proportional to the total force $F_T$) and the second weight of the fiber during the advancing contact angle (the bouyant force $F_B$), the wetting force $F_W$ can be determined algebraically. Measurements of the fiber perimeter and the surface tension of the wetting liquid; combined with the Wilhelmy equation, yield the advancing contact angle. The resulting measurements of the advancing contact angles are shown in Table 6B.

TABLE 6B

| Sample Type \ No. | 1 | 2 | 3 | 4 | 5 | AVERAGE |
|---|---|---|---|---|---|---|
| Internal Siloxane | 96.1° | 99.8° | 127.7° | 97.4° | 103.1° | 104.8° |
| Control | 94.6° | 94.6° | 94.6° | 83.7° | 90.4° | 91.6° |

As can be seen from these results, none of the control fibers had an advancing contact angle equal to or greater than about 95°, whereas the fibers of this invention always presented an advancing contact angle equal to or greater than about 95°. The average advancing contact angle for the present fibers is about 15% greater than that for the controls. Further, it can be seen that the instrinsic hydrophobicity of the control fibers is increased by the present invention.

EXAMPLE 6C

Using the same fine denier fibers made as described above according to Ex. 6A, these fibers were compared with control fibers to determine the amount, if any, of the lubricant that is extracted. The invention fibers were compared with a commercially available T-190™ polypropylene fiber (available from Hercules Incorporated, Wilmington, Del.) having a typical polysiloxane topical finish composition applied to the surface of the fiber.

At the time of this comparison testing, the inventive fibers containing 1.3 wt. % internal poly(dimethylsiloxane) lubricant were about 2½ years old (i.e., about 2½ years since having been spun) and the control fibers were a little over one year old.

For each test, a 5 g sample of the fiber was weighed to the nearest 0.0001 g and placed in an extraction thimble. About 50 ml of methylene chloride ($CH_2Cl_2$) was poured into the thimble and allowed to drip into an aluminum cup disposed below the thimble; after gravity dripping was stopped, pressure (about 40 psi) was applied until all dripping had stopped.

The fiber was then removed from the thimble, placed on a sheet of aluminum foil, and heated on a steambath to dryness.

The extract in the cup was heated on the steambath to dryness. This extract residue was dissolved by mixing with 1.5 ml m-xylene, three times, and then brought to a total volume of 10 ml by the addition of m-xylene.

A series of standards were prepared by weighing to the nearest 0.0001 g poly(dimethylxiloxane) (PDMS) in separate flasks and mixing each with m-xylene as shown in Table 6C-1:

TABLE 6C-1

| Standard | 1 | 2 | 3 | 4 | 5 | 6 |
|---|---|---|---|---|---|---|
| PDMS (mg) | 4 | 8 | 12 | 16 | 24 | 28 |
| Vol. PDMS (g/ml) | 0.0004 | 0.0008 | 0.0012 | 0.0016 | 0.0024 | 0.0028 |

The infrared spectrum from 4,000 to 625 $cm^{-1}$ was plotted for each of these standards in a 0.5 mm $CaCl_2$ cell against a m-xylene blank. The xylene background was subtracted from each measurement. The absorbance at 1260 $cm^{-1}$ between the peak maximum measurement and the baseline (between 1300 and 1200 $cm^{-1}$; the $SiCH_3$ band is generally between 1260 and 1265 $cm^{-1}$) was measured, and then plotted against the volume PDMS values (0.0004, 0.0008, etc.). A linear regression analysis was used to calculate the slope and intercept of this standardization curve; the slope was determined to be 0.02292.

Now that a reference curve was established, the original extract samples, now in 10 ml xylene solutions, were measured in an infrared spectrometer with the extract in a 0.5 mm sample cell and straight m-xylene in the reference cell. A tangent baseline was drawn from 1283 $cm^{-1}$ to 1235 $cm^{-1}$ and the peak height of the 1260 $cm^{-1}$ was determined. The weight percentage of PDMS in the extract was determined from the equation A÷X=mg silicone in extract, where A is the absorbance and X is the coefficient factor (0.02292), and 0.1×[mg silicone]÷[sample wt. (g)] is the percent silicone finish extracted.

On average, 0.05% PDMS (fiber weight basis) was extracted form the fibers of this invention, and 0.12% PDMS was extracted from the control fibers. As noted above, topical silicone finishes are typically applied in amounts of 0.1–0.2% by weight. Accordingly, essentially all of the lubricant applied to the surface of the control fiber was extracted. In contrast, extraction of the novel fibers of this invention including 1.3wt. % polysiloxane, after two and one-half years, yielded only 0.05% of PDMS. Whereas the prior art may have expected the internal polysiloxane to have migrated to the fiber surface, the extraction after two years of only about 4% of the initial polysiloxane present in the fiber is contrary to such expectations, and significantly improved from the nearly 100% of the polysiloxane removed from the surface of the surface-modified fibers. Thus, the present invention provides polyolefin fibers having an essentially non-extractable internal lubricant, preferably of the formula $$X—A^1—[Si(A^2R^1)(A^3R^2)—O]_z—A^4—Y$$

as herein defined.

Various embodiments of the invention having been described above, additions, deletions, and substitutions of particular compounds and modifications of particular process parameters may come to the mind of the artisan after a perusal of this specification, and such variations are intended to be within the scope and spirit of the invention as defined by the following claims.

What is claimed is:

1. A method for making an article of manufacture, comprising:

A. providing a spinnable polymer melt comprising a polyolefin-containing polymer and a polysiloxane of the formula $[X—[Si(R^1)(R^2)—O—]_z—Y,]$ in which X and Y are independently selected from aliphatic groups having not more than about twenty-two carbon atoms and ethers thereof, z ranges from about 10 to about 50 or more, and (a) $R^1$ and $R^2$ are independently selected from aliphatic groups having not more than about twenty-two carbon atoms and the polysiloxane has a molecular weight of at least about 15,000 or (b) at least one of $R^1$ and $R^2$ is an arene group and the other is an arene group or an aliphatic group having not more than about twenty-two carbon atoms; and B. spinning said melt into an as-spun fiber.

2. The method of claim 1, further comprising drawing said as-spun fiber to produce a drawn fiber.

3. The product produced by the process of claim 1.

4. A method for making an article of manufacture, comprising:

A. providing a spinnable polymer melt comprising a polyolefin-containing polymer and a polysiloxane of the formula $[X—[Si(R^1)(R^2)—O—]_2—Y]$ in which X and Y are independently selected from aliphatic groups having not more than about twenty-two carbon atoms and ethers thereof, z ranges from about 10 to about 50 or more, and (a) $R^1$ and $R^2$ are independently selected from aliphatic groups having not than about twenty-two carbon atoms and the polysiloxane has a molecular weight of at least about 15,000 or (b) at least one of $R^1$ and $R^2$ is an arene group and the other is an arene group or an aliphatic group having not more than about twenty-two carbon atoms; and B. spinning said melt into an as-spun fiber, and C. cutting the as-spun fiber into staple fibers.

5. The method of claim 4, further comprising crimping as-spun fiber to produce crimped staple fibers.

6. The product produced by the process of claim 4.

7. An as-spun lubricated fiber produced by the process comprising:

A. providing a spinnable polymer melt comprising a polyolefin-containing polymer and a polysiloxane of the formula $[X—[Si(R^1)(R^2)—O—]_2—Y,]$ in which X and Y are independently selected from aliphatic groups having not more than about twenty-two carbon atoms and ethers thereof, z ranges from about 10 to about 50 or more, and (a) $R^1$ and $R^2$ are independently selected from aliphatic groups having not more than about twenty-two carbon atoms and the polysiloxane has a molecular weight of at least about 15,000 or (b) at least one of $R^1$ and $R^2$ is an arene group and the other is an arene group or an aliphatic group having not more than about twenty-two carbon atoms; and B. spinning said melt into an as-spun fiber.

8. The product produced by the process defined by claim 7, further comprising cutting the fiber into staple fibers.

* * * * *